US011442409B2

(12) United States Patent
Denden

(10) Patent No.: US 11,442,409 B2
(45) Date of Patent: Sep. 13, 2022

(54) DEVICE FOR ADJUSTING A RETROGRADE TIMEPIECE DISPLAY

(71) Applicant: Blancpain SA, Le Brassus (CH)

(72) Inventor: Mehdi Denden, Les Rousses (FR)

(73) Assignee: Blancpain SA, Le Brassus (CH)

( * ) Notice: Subject to any disclaimer, the term of this patent is extended or adjusted under 35 U.S.C. 154(b) by 450 days.

(21) Appl. No.: 16/589,244

(22) Filed: Oct. 1, 2019

(65) Prior Publication Data

US 2020/0117142 A1 Apr. 16, 2020

(30) Foreign Application Priority Data

Oct. 12, 2018 (EP) ..... 18200130

(51) Int. Cl.
*G04B 19/02* (2006.01)
*G04B 19/04* (2006.01)

(52) U.S. Cl.
CPC ..... *G04B 19/02* (2013.01); *G04B 19/04* (2013.01)

(58) Field of Classification Search
CPC ..... G04B 19/04; G04B 19/02; G04B 35/00; G04B 19/082; G04B 19/00; G04B 19/042; G04B 19/044; G04B 45/0061
See application file for complete search history.

(56) References Cited

U.S. PATENT DOCUMENTS 5,280,461 A * 1/1994 Belik ..... G04B 45/00 368/228
2008/0310259 A1 12/2008 Groothuis
2009/0040880 A1 2/2009 Ruchonnet et al.
2010/0246341 A1* 9/2010 Papi ..... G04B 19/02 368/220
2015/0016232 A1* 1/2015 Graemiger ..... G04B 19/082 368/132

(Continued)

FOREIGN PATENT DOCUMENTS

CN 101416126 A 4/2009
CN 101512446 A 8/2009
CN 102279558 A 12/2011

(Continued)

OTHER PUBLICATIONS

European Search Report dated Mar. 14, 2019 in European Application 18200130.5 filed on Oct. 12, 2018 (with English Translation of Categories of Cited Documents).

(Continued)

*Primary Examiner* — Edwin A. Leon
(74) *Attorney, Agent, or Firm* — Oblon, McClelland, Maier & Neustadt, L.L.P.

(57) ABSTRACT

A retrograde display mechanism including a main plate and a rack pivoting on a first arbor about a first axis centring its toothing, and including a sensing element following a cam pivoting on a second arbor about a second axis, the position of the first pivot axis and/or of the second pivot axis is adjustable with respect to the main plate with an adjustment plate carrying the first arbor and/or respectively the second arbor, and movable with at least one degree of freedom with respect to the main plate whose position with respect to the main plate is adjustable by an adjustment control device or an eccentric screw secured to the main plate and cooperating with a notch in the adjustment plate, or vice versa.

16 Claims, 3 Drawing Sheets

(56) References Cited

U.S. PATENT DOCUMENTS

2017/0242400 A1 8/2017 Denden et al.

FOREIGN PATENT DOCUMENTS

| | | | |
|---|---|---|---|
| CN | 102346426 | A | 2/2012 |
| EP | 3 208 665 | A1 | 8/2017 |
| JP | 53-81 079 | | 7/1978 |
| JP | 2006-226990 | A | 8/2006 |
| JP | 2009-531 684 | A | 9/2009 |
| JP | 2017-146301 | A | 8/2017 |

OTHER PUBLICATIONS

Notice of the Reason for Refusal dated Aug. 4, 2020 in Japanese Patent Application No. 2019-178282 (with English translation), 4 pages.

Combined Chinese Office Action and Search Report dated Nov. 20, 2020 in corresponding Chinese Patent Application No. 201910965529.X (with English Translation of Category of Cited Documents), 6 pages.

* cited by examiner

DEVICE FOR ADJUSTING A RETROGRADE TIMEPIECE DISPLAY

CROSS-REFERENCE TO RELATED APPLICATION

This application claims priority to European Patent Application No. 18200130.5 filed on Oct. 12, 2018, the entire disclosure of which is hereby incorporated herein by reference.

FIELD OF THE INVENTION

The invention concerns a retrograde timepiece display mechanism, comprising a main plate and at least one rack pivotally mounted on a first arbor pivoting about a first pivot axis and comprising a toothing centred on said first pivot axis, which rack includes a sensing finger arranged to follow the periphery of a cam comprised in said retrograde display mechanism and which is pivotally mounted on a second arbor pivoting about a second pivot axis.

The invention also concerns a timepiece movement including at least one such retrograde display mechanism.

The invention also concerns a timepiece, especially a watch, including at least one such retrograde display mechanism.

The invention concerns the field of timepiece display mechanisms, and more specifically the field of retrograde display mechanisms.

BACKGROUND OF THE INVENTION

Retrograde display mechanisms that utilise a cam and a sensing finger are, by design, inaccurate. Indeed, the inaccuracy depends on the gear ratio between the sensing rack and the display pinion. In a concrete example, if the available space only allows an angle of motion of the rack of 25°, whereas the display on the dial must be 270°, then this configuration entails a gear ratio of 10.8, and the logical consequence is that any inaccuracy (positioning tolerances of the elements, shape tolerances, pivot play, deformation when the cam is pressed onto its arbor, or the sensing rack onto its arbor, and otherwise) is amplified by the same factor on the display. Any error is thus amplified in the same ratio owing to the gear ratio. It is thus possible that the display initially intended for an angular sector of 270', only appears on an angular sector of 266° or 274°, which is noticeable, and unpleasant for the user, since the optical effect may be further amplified by the design of the dial.

SUMMARY OF THE INVENTION

The invention proposes to develop a system of adjusting the angle of a retrograde display that overcomes the limitations of the prior art, and to ensure good display accuracy.

The invention proposes a simple adjustment system which exploits this high reduction ratio between the sensing rack and the display pinion.

To this end, the invention concerns a retrograde timepiece display mechanism according to claim 1.

The invention also concerns a timepiece movement including at least one such retrograde display mechanism.

The invention also concerns a timepiece, especially a watch, including at least one such retrograde display mechanism.

The invention allows a slight shift of the pivot centre of the sensing rack, and/or of the cam. For example, in the example illustrated by the Figures presented below, a variation in the angle of the sensing rack of +/−0.37° allows an adjustment of +/−4° on the retrograde display. This adjustment is necessary since it makes it possible to compensate for manufacturing inaccuracies of the components which are unpredictable from one batch to another.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
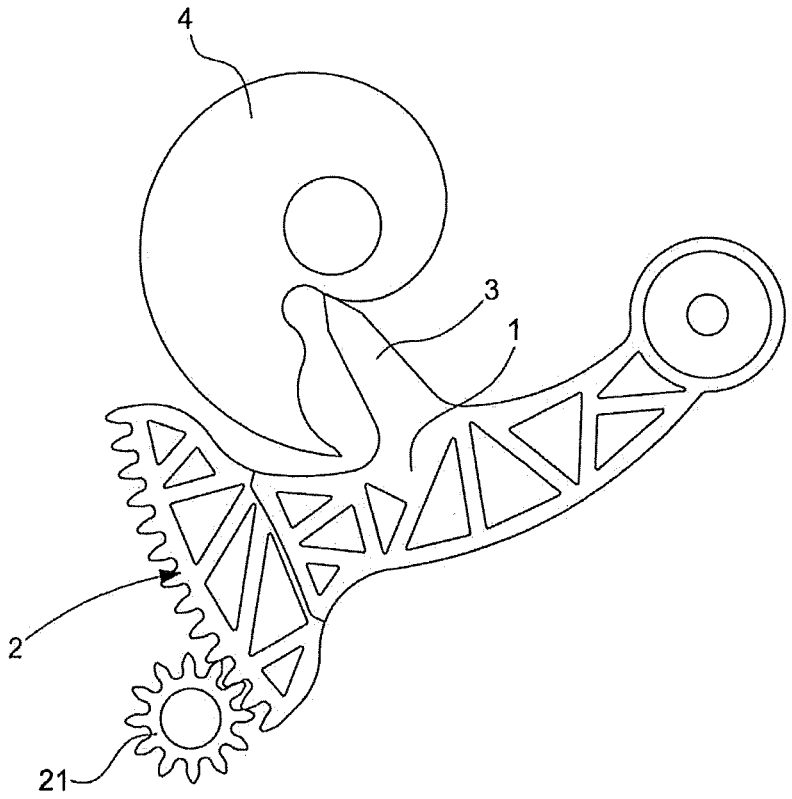
FIG. 1 represents a schematic plan view of a retrograde display controller according to the prior art, with a sensing rack pivoted on a main plate, and comprising a finger following the peripheral contour of a snail cam, the sensing rack includes a toothed sector which meshes with a pinion carrying a retrograde display member such as a hand.
Figure 2:
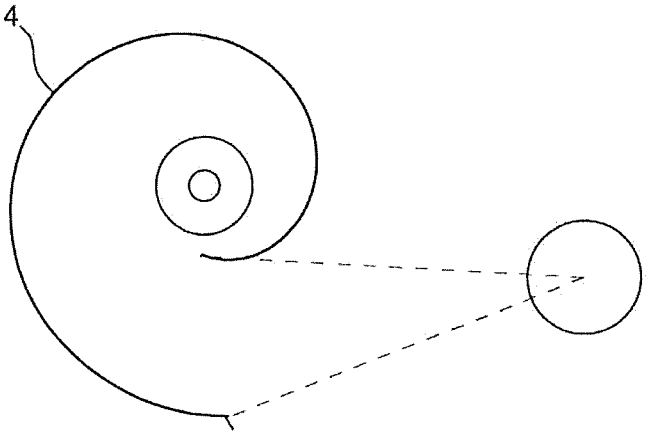
FIG. 2 represents, in a similar manner to FIG. 1, the geometry of the profile of the cam of FIG. 1, and the retrograde return position when the sensing element drops onto the snail.
Figure 3:
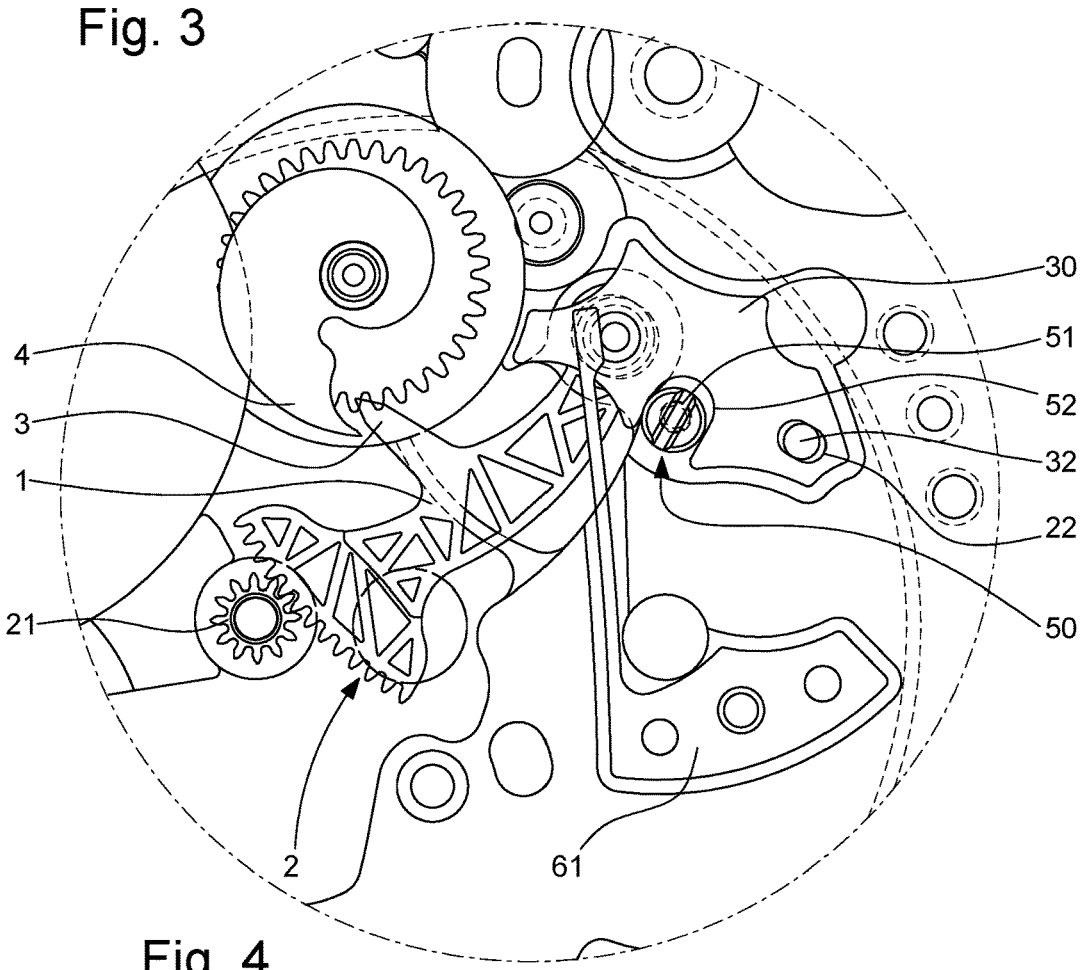
FIG. 3 represents, in a similar manner to FIG. 1, a retrograde display mechanism according to the invention, in a particular variant wherein the position of the sensing rack arbor is adjustable, by means of an intermediate plate which supports the arbor and whose position is adjustable with respect to the main plate, particularly by two guide apertures or holes and an eccentric adjustment screw, and wherein a play compensation spring bears on this arbor, and always forces the plate in the same direction, to make up for any play, and to avoid deindexing during adjustment and in case of any shocks.
Figure 4:
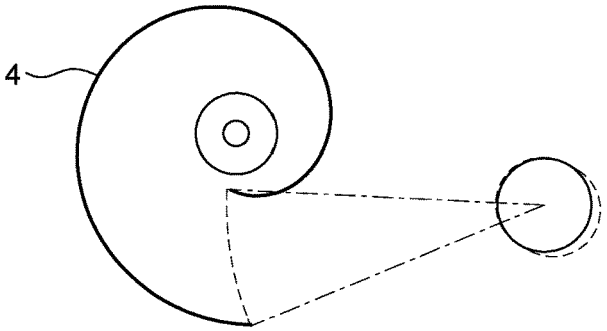
FIG. 4 represents, in a similar manner to FIG. 2, the geometry of the profile of the cam of FIG. 3, and the retrograde return position when the sensing element drops onto the snail, and a displacement of the axis of rotation of the sensing rack arbor towards the cam with respect to its theoretical position, with a value of 0.0493 mm corresponding to an angle of drop of 25.2991° onto the snail.
Figure 6:
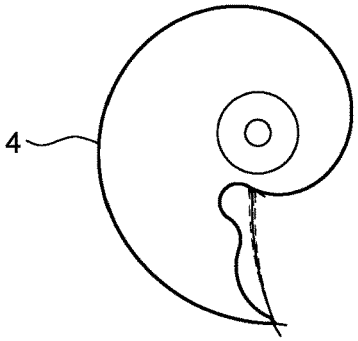
FIG. 6 represents, in a similar manner to FIGS. 4 and 5, the point of contact of the sensing finger with the cam during the retrograde return, in these two positions on either side of the theoretical position.
Figure 5:
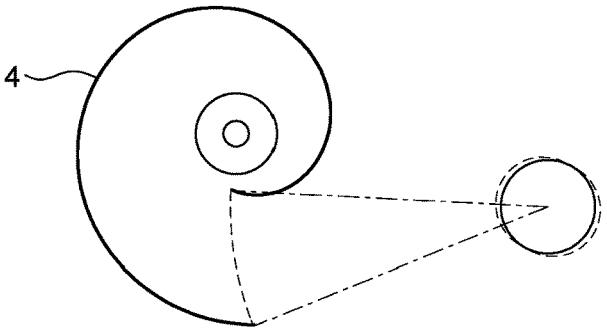
FIG. 5 represents, in a similar manner to FIG. 4, the geometry of the profile of the cam of FIG. 3, and the retrograde return position when the sensing element drops onto the snail, and a displacement of the axis of rotation of the sensing rack arbor away from the cam with respect to its theoretical position, with a value of 0.0585 mm corresponding to an angle of drop of 24.5679° onto the snail.

The invention concerns a retrograde timepiece display mechanism 10, comprising a main plate 20 and at least one sensing rack 1. This rack 1 is pivotally mounted on a first arbor 11 pivoting about a first pivot axis D1, and includes a toothing 2 centred on this first pivot axis D1. Rack 1 includes a sensing finger 3, which is arranged to follow the periphery of a cam 4, comprised in this retrograde display mechanism 10, and which is pivotally mounted on a second arbor 12 pivoting about a second pivot axis D2. Toothing 2 of rack 1 is arranged to drive a display pinion 21, which carries or drives a display member such as a hand or similar, not represented in the Figures.

In the non-limiting example illustrated by the Figures, the reduction ratio between the sensing rack and the display pinion is 130/12. A total theoretical angle of the rack of 24.929° corresponds to a theoretical angle of 270.06° on the display pinion. Naturally, if through the manufacturing process, minimal errors accumulate, and especially are amplified owing to the gear ratio, the real angle of the retrograde display may differ substantially from its theoretical value of 270°, and have a value, for example, of only 267', which is noticeable on the display and which should be avoided.

The inevitable errors have several sources, the effects of which are cumulative: positioning tolerances of the elements, shape tolerances, pivot play, deformation when the cam is pressed onto its arbor, or the sensing rack onto its arbor, and otherwise.

The invention proposes a novel design with an adjustment system: the sensing rack pivots on an arbor which is mounted on a plate, which can slide, via an eccentric screw, along at least one axis determined to have the greatest impact on the angle of the sensing element.

Thus, according to the invention, the position of first pivot axis D1 and/or of second pivot axis D2 is adjustable with respect to main plate 20 by means of an adjustment plate 30, 40, carrying first arbor 11 and/or respectively second arbor 12, and movably mounted with at least one degree of freedom with respect to main plate 20, and whose position with respect to main plate 20 is adjustable by an adjustment control means 50, in order to adjust the total angle of the retrograde display.

Figure 7:
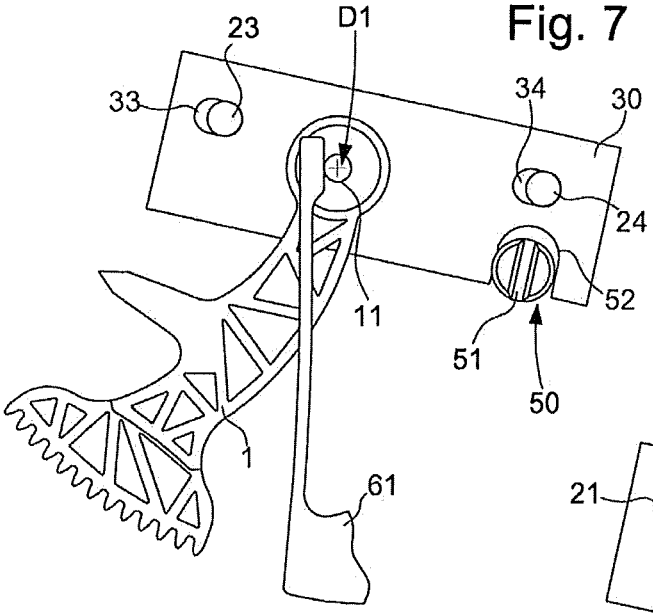
FIG. 7 represents a schematic plan view of an adjustment variation wherein the position of the axis of the sensing element is adjustable via a plate comprising oblong holes cooperating with trunnions comprised in the main plate.
Figure 8:
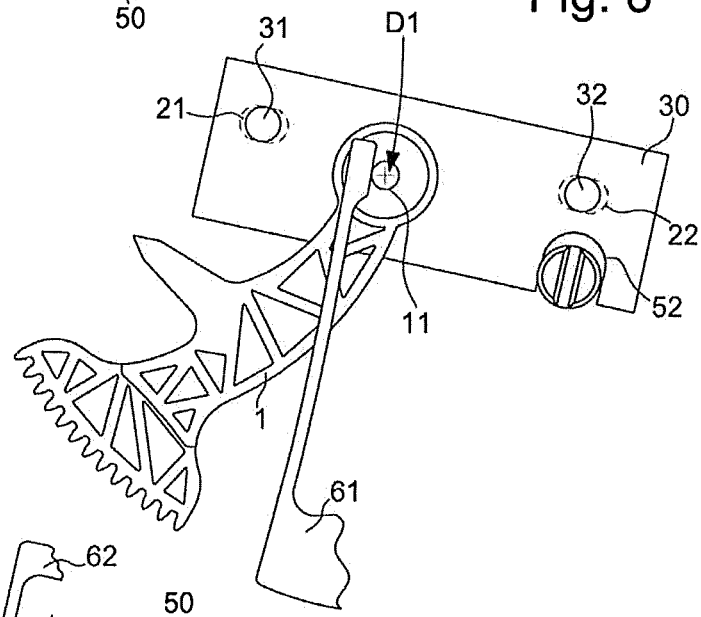
FIG. 8 represents a schematic plan view of an adjustment variant wherein the position of the axis of the sensing element is adjustable via a plate comprising trunnions cooperating with oblong holes comprised in the main plate.
Figure 9:
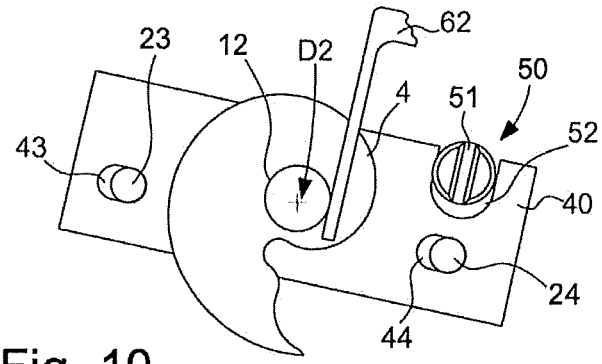
FIG. 9 represents a schematic plan view of an adjustment variant wherein the position of the cam axis is adjustable via a plate comprising oblong holes cooperating with trunnions comprised in the main plate.
Figure 10:
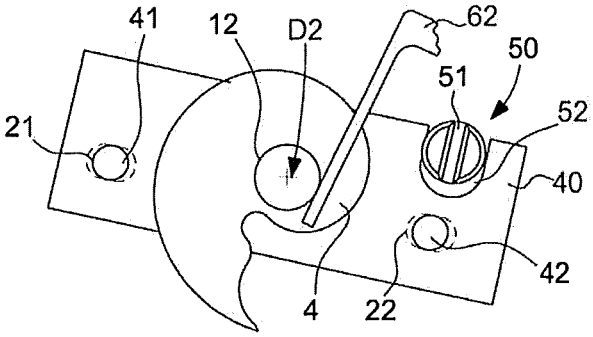
FIG. 10 represents a schematic plan view of an adjustment variant wherein the position of the cam axis is adjustable via a plate comprising trunnions cooperating with oblong holes comprised in the main plate.
Figure 11:
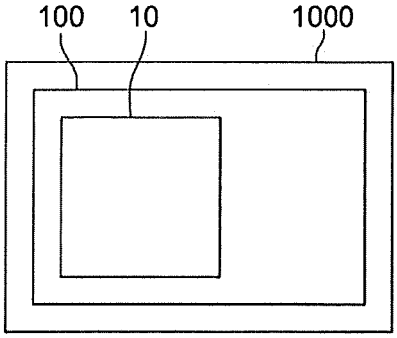
FIG. 11 is a block diagram representing a timepiece, in particular a watch, including a movement which in turn includes such a retrograde display mechanism.

More particularly, adjustment plate 30, 40 includes at least one trunnion 31, 32, 41, 42, movable in an oblong hole 21, 22, comprised in the main plate, and/or includes at least one oblong hole 33, 34, 43, 44, arranged to cooperate with a trunnion 23, 24 comprised in main plate 20. Let us recall that in horology an oblong hole is an oblong guide aperture. FIGS. 7 to 11 illustrate non-limiting variants of these configurations, in a simple version where the oblong holes are rectilinear and wherein each adjustment plate is guided in translation by two oblong hole/trunnion pairs. Naturally other configurations can be envisaged, for example a single oblong hole in an arc of a circle allowing the adjustment plate to pivot, or with more than two oblong holes, particularly with the use of oblong holes with crossed directions allowing two-dimensional positioning with respect to the plane of the main plate. The illustrated variants have the advantage of being very simple, easy to implement and of perfectly meeting the need for adjustment, especially when the direction of the oblong holes is substantially parallel to the direction defined together by the theoretical positions of first pivot axis D1 and second pivot axis D2.

Thus, in a variant, adjustment plate 30, 40 comprises two trunnions 31, 32, 41, 42, each mobile in an oblong hole 21, 22, comprised in the main plate. More particularly, first arbor 11 and/or respectively second arbor 12 forms one of trunnions 31, 32, 41, 42.

In another variant, adjustment plate 30, 40 includes two oblong holes 33, 34, 43, 44, each arranged to cooperate with a trunnion 23, 24 comprised in main plate 20.

Advantageously, retrograde display mechanism 10 includes at least one play compensation spring 61, 62 arranged to always push first arbor 11 and/or respectively second arbor 12 in the same direction with respect to main plate 20, and to retain adjustment plate 30, 40.

More particularly, adjustment control means 50 comprises an eccentric screw 51 secured to the plate and arranged to cooperate with a notch 52 comprised in adjustment plate 30, 40, or comprises a notch provided in main plate 20 and with which an eccentric screw secured to adjustment plate 30, 40 is arranged to cooperate. More particularly, the adjustment control means consists only of this single eccentric screw 51.

More particularly, sensing finger 3 is arranged to come into direct contact with cam 4 after the return-to-zero operation, with cam 4 forming an end of travel stop for sensing finger 3.

In a variant, adjustment control means 50 is arranged to control a translation of the centre of rotation of sensing finger 3 formed by first pivot axis D1.

A linear travel of first pivot axis D1 and/or of second pivot axis D2 corresponds to a preferred embodiment, which is inexpensive to produce and in which it is easy to return to a prior adjustment. This does not preclude the possibility of geometric adjustments that expand into the plane.

In a variant, adjustment control means 50 is arranged to control a rotation of the centre of rotation of sensing finger 3 formed by first pivot axis D1.

In a variant, adjustment control means 50 is arranged to control a translation of the centre of rotation of cam 4 formed by second pivot axis D2.

In a variant, the adjustment control means is arranged to control a rotation of the centre of rotation of cam 4 formed by second pivot axis D2.

In another non-illustrated variant, the positions of first pivot axis D1 and of second pivot axis D2 are adjustable, and their relative mobility is limited by a mechanical connection between their respective adjustment plates 30, 40, for example by a bar comprising two pins each moving in a hole in one of adjustment plates 30, 40, or otherwise.

Although the invention essentially concerns a zero position adjustment, it is possible to extrapolate the principle to dynamic adjustments. Thus, in yet another non-illustrated variant, adjustment means 50 are mobile during operation of the timepiece, for example eccentric screw 51 or 52 can be controlled by the timepiece movement to describe a periodic angular travel in one or both directions.

The invention also concerns a timepiece movement including at least one such retrograde display mechanism.

The invention also concerns a timepiece, especially a watch, including at least one such retrograde display mechanism.

As a result of the invention, it is possible to increase or decrease the total angle of a retrograde display to obtain an accurate display with a compact system. Indeed, generally, to avoid inaccuracy on the display, a ratio of close to 6 is required between the angle of the sensing element and the angle of the retrograde display. It is thus understood that, in order to have a 300° display on the dial without an adjustment system, there must be a sensing element covering an angle of 50°.

The sensing element moves back into contact with the cam after the return-to-zero operation; the cam is the minimum stop. This arrangement is better than mechanisms with adjustment systems in which the sensing element drops against an eccentric screw and not on the cam to increase the display angle, which then leads to another problem, which is that the display hand or the display member if it is a disc, or otherwise, remains stuck on zero for a certain time before moving off again.

In the variant illustrated by the Figures, a single eccentric screw makes it possible to adjust the display range. The adjustment is thus quite simple.

The configuration of the mechanism according to the invention is not very complex, to reliably adjust the angle of a retrograde display by displacement (in translation or rotation) of the centre of rotation of the sensing element and/or of the cam. The mechanism requires simply:

- a rack mounted on an adjustment plate allowing it to move in translation;
- this adjustment plate being controlled by an eccentric screw to facilitate intervention by the watch technician;
- a spring retaining the adjustment plate and making up for pivot play of the elements.

In short, the invention, which is simple to achieve, provides substantial advantages:

- the possibility of adjusting the retrograde display angle of an element simply through the action of an eccentric screw, and particularly a single eccentric screw;
- compensating for manufacturing intolerances for a retrograde display.

The invention claimed is:

1. A retrograde timepiece display mechanism, comprising:

a main plate; and at least one rack pivotally mounted on a first arbor pivoting about a first pivot axis and comprising a toothing centred on the first pivot axis, the at least one rack including a sensing finger arranged to follow a periphery of a cam comprised in the retrograde timepiece display mechanism and which is pivotally mounted on a second arbor pivoting about a second pivot axis, wherein a position of the first pivot axis and/or of the second pivot axis is adjustable with respect to the main plate with an adjustment plate carrying the first arbor and/or the second arbor, respectively, and is movably mounted with at least one degree of freedom with respect to the main plate, and wherein the position with respect to the main plate is adjustable by an adjustment control means, in order to adjust a total angle of the retrograde timepiece display mechanism.

2. The retrograde timepiece display mechanism according to claim 1, wherein the adjustment plate comprises at least one trunnion movable in an oblong hole comprised in the main plate, and/or at least one oblong hole arranged to cooperate with a trunnion comprised in the main plate.

3. The retrograde timepiece display mechanism according to claim 2, wherein the adjustment plate further comprises two trunnions each movable in an oblong hole comprised in the main plate.

4. The retrograde timepiece display mechanism according to claim 3, wherein the first arbor and/or the second arbor forms one of the trunnions.

5. The retrograde timepiece display mechanism according to claim 2, wherein the adjustment plate includes two oblong holes each arranged to cooperate with one trunnion comprised in the main plate.

6. The retrograde timepiece display mechanism according to claim 1, further comprising at least one play compensation spring arranged to always push the first arbor and/or the second arbor in a same direction with respect to the main plate and to retain the adjustment plate.

7. The retrograde timepiece display mechanism according to claim 1, wherein the adjustment control means comprises an eccentric screw secured to the main plate and arranged to engage with a notch comprised in the adjustment plate, or a notch provided in the main plate and arranged to engage with an eccentric screw fixed to the adjustment plate.

8. The retrograde timepiece display mechanism according to claim 7, wherein the adjustment control means further comprises only a single eccentric screw.

9. The retrograde timepiece display mechanism according to claim 1, wherein the sensing finger is further arranged to move back into direct contact with the cam after a return-to-zero operation, the cam forming an end of travel stop for the sensing finger.

10. The retrograde timepiece display mechanism according to claim 1, wherein the adjustment control means is arranged to control a translation of a centre of rotation of the sensing finger formed by the first pivot axis.

11. The retrograde timepiece display mechanism according to claim 1, wherein the adjustment control means is arranged to control a rotation of a centre of rotation of the sensing finger formed by the first pivot axis.

12. The retrograde timepiece display mechanism according to claim 1, wherein the adjustment control means is arranged to control a translation of a centre of rotation of the cam formed by the second pivot axis.

13. The retrograde timepiece display mechanism according to claim 1, wherein the adjustment control means is arranged to control a rotation of a centre of rotation of the cam formed by the second pivot axis.

14. A timepiece movement including at least one retrograde timepiece display mechanism according to claim 1.

15. A timepiece including at least one retrograde timepiece display mechanism according to claim 1.

16. The timepiece according to claim 15, wherein the timepiece is a watch.

* * * * *